US011215941B2

(12) United States Patent
Egawa

(10) Patent No.: US 11,215,941 B2
(45) Date of Patent: Jan. 4, 2022

(54) ELECTROPHOTOGRAPHIC BELT AND ELECTROPHOTOGRAPHIC IMAGE FORMING APPARATUS

(71) Applicant: CANON KABUSHIKI KAISHA, Tokyo (JP)

(72) Inventor: Noriaki Egawa, Komae (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/903,740

(22) Filed: Jun. 17, 2020

(65) Prior Publication Data

US 2021/0003943 A1 Jan. 7, 2021

(30) Foreign Application Priority Data

Jul. 2, 2019 (JP) ..... JP2019-123617

(51) Int. Cl.
*G03G 15/16* (2006.01)

(52) U.S. Cl.
CPC ..... *G03G 15/161* (2013.01); *G03G 15/162* (2013.01)

(58) Field of Classification Search
None
See application file for complete search history.

(56) References Cited

U.S. PATENT DOCUMENTS

| | | | | |
|---|---|---|---|---|
| 8,445,071 | B2 | 5/2013 | Egawa et al. | |
| 8,512,811 | B2 | 8/2013 | Egawa et al. | |
| 10,551,771 | B2 | 2/2020 | Uchida et al. | |
| 2012/0201578 | A1* | 8/2012 | Mashiko | G03G 15/162 399/308 |
| 2014/0212657 | A1* | 7/2014 | Kanai | G03G 15/162 428/327 |
| 2014/0286682 | A1* | 9/2014 | Sakamoto | G03G 15/162 399/302 |
| 2015/0177653 | A1* | 6/2015 | Seki | G03G 15/161 399/101 |

FOREIGN PATENT DOCUMENTS

| | | |
|---|---|---|
| JP | 2004-361765 | 12/2004 |
| JP | 2014-080603 | 5/2014 |
| JP | 2014-160231 | 9/2014 |
| JP | 5609506 | 10/2014 |

* cited by examiner

*Primary Examiner* — Jas A Sanghera
(74) *Attorney, Agent, or Firm* — Venable LLP

(57) ABSTRACT

Provided is an electrophotographic belt that can suppress the occurrence of a cleaning failure even when used for a long time period. The electrophotographic belt includes a surface layer containing a first acrylic resin, wherein resin particles are present on an outer surface thereof, wherein the resin particles each contain a second acrylic resin and a fluorine resin, and wherein the second acrylic resin and the fluorine resin are exposed to an outer surface of each of the resin particles.

13 Claims, 4 Drawing Sheets

ELECTROPHOTOGRAPHIC BELT AND ELECTROPHOTOGRAPHIC IMAGE FORMING APPARATUS

BACKGROUND OF THE INVENTION

Field of the Invention

The present disclosure relates to an electrophotographic belt, such as a conveyance transfer belt or an intermediate transfer belt, and to an electrophotographic image forming apparatus including an electrophotographic belt.

Description of the Related Art

In an electrophotographic image forming apparatus, an electrophotographic belt is used as a conveyance transfer belt configured to convey a recording medium serving as a transfer material, or as an intermediate transfer belt configured to temporarily bear toner images for transfer.

In Japanese Patent Application Laid-Open No. 2004-361765, there is a disclosure of an electrophotographic image forming apparatus in which the cleaning performance of a cleaning blade on residual toner on an intermediate transfer belt can be improved. The cleaning device of the electrophotographic image forming apparatus includes a powdery release agent-applying device configured to apply a powdery release agent, specifically zinc stearate powder to the outer peripheral surface of the intermediate transfer belt.

According to the electrophotographic image forming apparatus disclosed in Japanese Patent Application Laid-Open No. 2004-361765, the release agent is continuously supplied to the intermediate transfer belt. Accordingly, even when the apparatus is used over a long time period, the occurrence of a cleaning failure can be prevented. However, the presence of the powdery release agent-applying device may be an obstacle to the downsizing and cost reduction of the electrophotographic image forming apparatus.

One aspect of the present disclosure is directed to providing of an electrophotographic belt that can suppress the occurrence of a cleaning failure even when used for a long time period. Another aspect of the present disclosure is directed to providing of an electrophotographic image forming apparatus that can stably form a high-quality electrophotographic image.

SUMMARY OF THE INVENTION

According to one aspect of the present disclosure, there is provided an electrophotographic belt including a surface layer containing a first acrylic resin, wherein resin particles are present on an outer surface thereof, wherein the resin particles each contain a second acrylic resin and a fluorine resin, and wherein the second acrylic resin and the fluorine resin are exposed to an outer surface of each of the resin particles.

In addition, according to another aspect of the present disclosure, there is provided an electrophotographic image forming apparatus including: an electrophotographic belt; and a cleaning blade brought into abutment against an outer surface of the electrophotographic belt, wherein the electrophotographic belt is the above-mentioned electrophotographic belt.

Further features of the present invention will become apparent from the following description of exemplary embodiments with reference to the attached drawings.

BRIEF DESCRIPTION OF THE DRAWINGS

FIG. 1A is a perspective view, FIG. 1B is an enlarged view of the outer surface of the surface layer of the belt, and FIG. 1C is an enlarged view of the resin particle portion of the outer surface.

DESCRIPTION OF THE EMBODIMENTS

A release agent formed of metal soap or the like is liable to separate from the toner-carrying surface (hereinafter sometimes simply referred to as "surface") of an electrophotographic belt (hereinafter sometimes simply referred to as "belt"). That is, the release agent on the surface of the belt moves to, for example, a member in contact with the surface of the belt, such as paper (transfer material), a cleaning blade, or a photosensitive member, in accordance with an operation along with image formation, thereby disappearing from the surface of the belt.

Meanwhile, an acrylic resin may be incorporated into a surface layer for forming the surface of the belt for the purpose of, for example, imparting wear resistance. The inventors have found that in the case where resin particles each containing another acrylic resin and a fluorine resin are caused to adhere to the surface of the belt including the surface layer containing the acrylic resin, the resin particles hardly disappear from the surface even when the belt is used over a long time period, and hence the occurrence of a cleaning failure can be sustainably prevented.

This is probably because of the following reason. The acrylic resin in the surface layer and the acrylic resin in each of the resin particles have a high affinity for each other, and while the acrylic resins tend to be positively charged, the fluorine resin tends to be negatively charged. Thus, the resin particles more strongly adhere to the surface of the belt.

In addition, the fluorine resin has a lubricating effect. Accordingly, when the resin particles stably adhere to the surface of the belt, a satisfactory cleaning property may be maintained over a long time period.

An electrophotographic belt according to one aspect of the present disclosure is described in detail below. The present disclosure is not limited to the following aspect.

<Electrophotographic Belt and Resin Particles>

The electrophotographic belt includes a surface layer containing a first acrylic resin, typically a surface layer formed of the first acrylic resin. For example, the electrophotographic belt includes a base layer having an endless belt shape, and a surface layer arranged on the outer peripheral surface of the base layer.

An elastic layer may be arranged between the base layer and the surface layer. The presence of the elastic layer exhibits, for example, the following effect: the transferability of a toner image onto a recording material in a secondary transfer step is further improved.

Figure 1A:
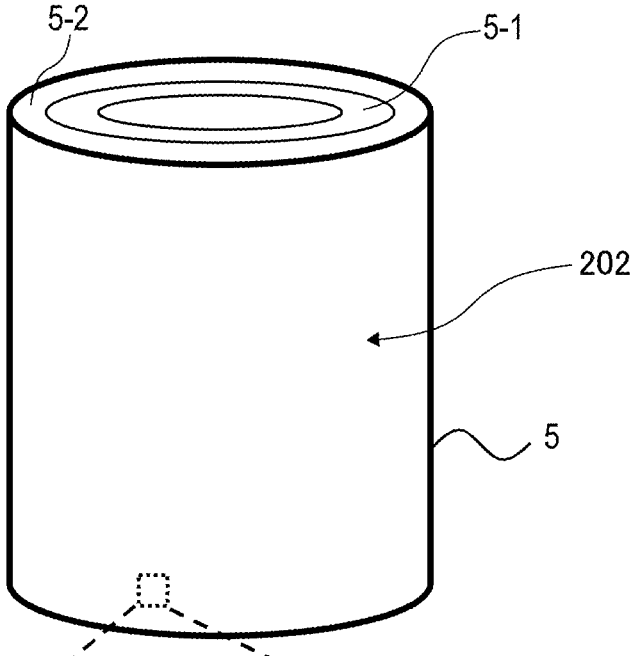
FIG. 1A, FIG. 1B and FIG. 1C are each a schematic view for illustrating an example of an electrophotographic belt according to one aspect of the present disclosure.

An electrophotographic belt 5 illustrated in FIG. 1A has an endless belt shape. The electrophotographic belt includes a base layer 5-1 having an endless belt shape, and a surface layer 5-2 formed on the outer peripheral surface of the base layer 5-1. The surface layer 5-2 contains at least the first acrylic resin.

Figure 1B:
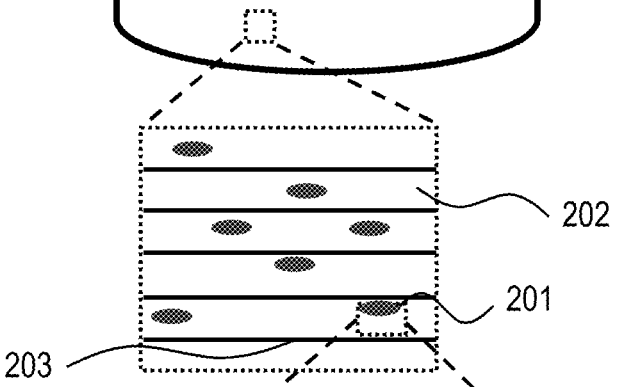
Figure 1C:
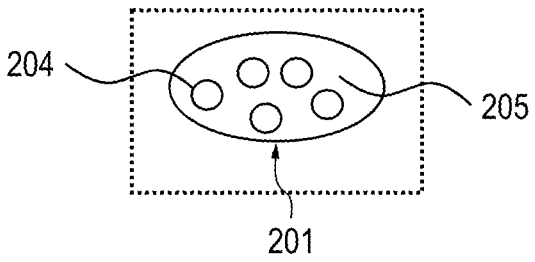

As illustrated in FIG. 1B, resin particles 201 are present on the outer surface 202 of the electrophotographic belt. In addition, FIG. 1C is a schematic view of the surface of one of the resin particles 201. As illustrated in FIG. 1C, the resin particle 201 contains a second acrylic resin 205 and a fluorine resin 204, and the fluorine resin 204 and the second acrylic resin 205 are exposed to the outer surface of the resin particle 201.

The first acrylic resin and the second acrylic resin in each of the resin particles preferably have repeating units of the same structure. Thus, an affinity between the outer surface of the belt and the resin particles is improved to make it easy to sustain a preventing effect on the occurrence of a cleaning failure over a longer time period. In particular, the first acrylic resin and the second acrylic resin are preferably identical to each other.

In the outer surface 202 of the surface layer, it is preferred that the resin particles be present in a larger amount in both end portions in the width direction of the belt 5 than in a central portion therein. Both the end portions of the belt deviate from a region where an image is to be formed, and hence the amount of toner to be supplied to the portions is small. In addition, a pressing pressure in each of the portions is stronger than that in the central portion because of the deflection of a cleaning blade, and hence friction becomes larger. A cleaning failure is more liable to occur early in the region of each of both the end portions where the friction is large than in the region of the central portion where the friction is small owing to, for example, the chipping or wear of the blade. Accordingly, when the resin particles are present in a larger amount in both the end portions than in the central portion, the occurrence of a cleaning failure can be more sustainably suppressed. A portion distant from an end in the width direction of the belt toward the center in the width direction of the belt by up to 20 mm is adopted as an end portion, and a portion closer to the center with respect to the end portions is adopted as the central portion.

In addition, it is preferred that the outer surface 202 of the surface layer have arranged therein a plurality of grooves 203 extending in the peripheral direction of the electrophotographic belt. When the grooves are arranged, friction between the belt and the cleaning blade is reduced, and hence the occurrence of a cleaning failure can be more sustainably suppressed.

When putting a predetermined sized observing region such as 715 μm×535 μm, at any positions on the outer surface 202, the ratio of total areas of which the resin particles 201 which cover the outer surface 202 in the observing region with respect to an area of the observing region (hereinafter sometimes referred to as "particle-covering area ratio") is preferably 0.1% or more, more preferably 0.5% or more from the viewpoint of reducing the friction between the electrophotographic belt and the cleaning blade. The particle-covering area ratio is preferably 35% or less from the viewpoints of toner transfer efficiency and image quality. When the central portion and both the end portions in the width direction of the belt have different particle-covering area ratios, the particle-covering area ratio in each of the central portion and both the end portions preferably falls within the ranges.

Each of the first and second acrylic resins is preferably a polymerized product of a polyfunctional acrylate monomer. Thus, the friction is easily reduced, and hence the occurrence of a cleaning failure can be more sustainably suppressed.

As the polyfunctional acrylate monomer, there may be used, for example, dipentaerythritol pentaacrylate, dipentaerythritol hexaacrylate, pentaerythritol triacrylate, pentaerythritol tetraacrylate, trimethylolpropane triacrylate, trimethylolpropane PO-modified triacrylate, trimethylolpropane EO-modified triacrylate, isocyanuric acid EO-modified triacrylate, ditrimethylolpropane tetraacrylate, diglycerin EO-modified acrylate, and bisphenol EO-modified diacrylate. Herein, "EO" represents "ethylene oxide", and "PO" represents "propylene oxide". However, each of the first and second acrylic resins may be a polymerized product of a monofunctional acrylate monomer, such as N-acryloyloxyethylhexahydrophthalimide, o-phenylphenol EO-modified acrylate, p-cumylphenol EO-modified acrylate, or nonylphenol EO-modified acrylate. Each of those first and second acrylic resins may be a homopolymer or a copolymer, or may be a mixture of a plurality of kinds of acrylic resins.

The fluorine resin in the resin particles 201 is preferably a polytetrafluoroethylene. When the polytetrafluoroethylene is used, the friction between the belt and the cleaning blade is further reduced, and hence the occurrence of a cleaning failure can be more sustainably suppressed. However, the fluorine resin is not limited thereto, and for example, a perfluoropolyether may also be used as the fluorine resin. Other examples of the fluorine resin include a polyvinylidene fluoride, a polyvinyl fluoride, a perfluoroalkoxy fluorine resin, a tetrafluoroethylene-hexafluoropropylene copolymer, and an ethylene-tetrafluoroethylene copolymer. The fluorine resin may be a homopolymer or a copolymer, or may be a mixture of a plurality of kinds of fluorine resins.

It is preferred that the content of the second acrylic resin in the resin particles 201 be 24 mass % or more and 90 mass % or less, and the content of the fluorine resin therein be 5 mass % or more and 70 mass % or less. When the content of the second acrylic resin is 24 mass % or more, an adhesion force between the resin particles and the outer surface of the belt is kept satisfactory, and hence a sustainable cleaning failure-preventing effect is easily obtained. When the content of the second acrylic resin is 90 mass % or less, the friction is easily reduced. Similarly, when the content of the fluorine resin is 5 mass % or more, the friction is easily reduced. When the content of the fluorine resin is 70 mass % or less, the adhesion force between the resin particles and the outer surface of the belt is kept satisfactory, and hence a sustainable cleaning failure-preventing effect is easily obtained.

The base layer having an endless belt shape may be produced by using, for example, a method including subjecting a pellet of a thermoplastic resin composition to melt extrusion molding into a cylindrical shape, or a known method, such as an injection molding method, a stretch blow molding method, or an inflation molding method.

In addition, the surface layer may be formed by, for example, applying a paint for forming a surface layer to the outer peripheral surface of the base layer having an endless belt shape through the use of a known method, such as dip coating, spray coating, flow coating, shower coating, roll coating, spin coating, or ring coating, and drying and curing the applied paint.

The thickness of the electrophotographic belt is preferably 10 μm or more and 500 μm or less, particularly preferably 30 μm or more and 150 μm or less. In addition, the electrophotographic belt according to one aspect of the present disclosure may be used as a belt as it is, or may be used by being wound around a drum, a roll, or the like, which is used as an electrophotographic member, or by covering the drum, the roll, or the like. The thickness of the surface layer is preferably 0.1 μm or more and 50 μm or less, particularly preferably 0.5 μm or more and 10 μm or less. When the thickness is 0.1 μm or more, the durability of the belt against wear is easily made satisfactory. When the thickness is 50 μm or less, the occurrence of a crack due to repeated bending of the belt is easily suppressed.

A known method may be used as a method of producing the resin particles. For example, a method including using a ball mill, a jet mill, or a stamp mill configured to pulverize a solid may be used. In addition, a nozzle vibration method, a Shirasu porous glass (SPG) membrane emulsification method, a microchannel method, a miniemulsion polymerization method, a soap-free emulsion polymerization method, a dispersion polymerization method, a seed emulsion polymerization method, or the like including causing monomer molecules to react with each other in a liquid may be used.

The shapes and sizes of the resin particles are not particularly limited as long as the particles can express lubricity. However, from the viewpoint of preventing toner slipping when the resin particles are caught between the cleaning blade and the belt, the shortest outer diameter of each of the resin particles, that is, the short diameter thereof is preferably 10 μm or less, more preferably 5 μm or less.

Such arbitrary methods as described below may each be adopted as a method of causing the resin particles to adhere to the outer surface of the surface layer of the belt: a method including causing the resin particles to adhere to the outer surface directly (while being a solid) through the use of a sieve or the like; and a method including mixing the resin particles in a dispersion medium, such as water or an alcohol, applying the mixture to the outer surface, and then drying the dispersion medium.

The resin particles each contain the acrylic resin and the fluorine resin; a conductive agent, an antioxidant, a dispersant, or the like may be added to each of the particles as required.

<Electrophotographic Image Forming Apparatus>

Figure 2:
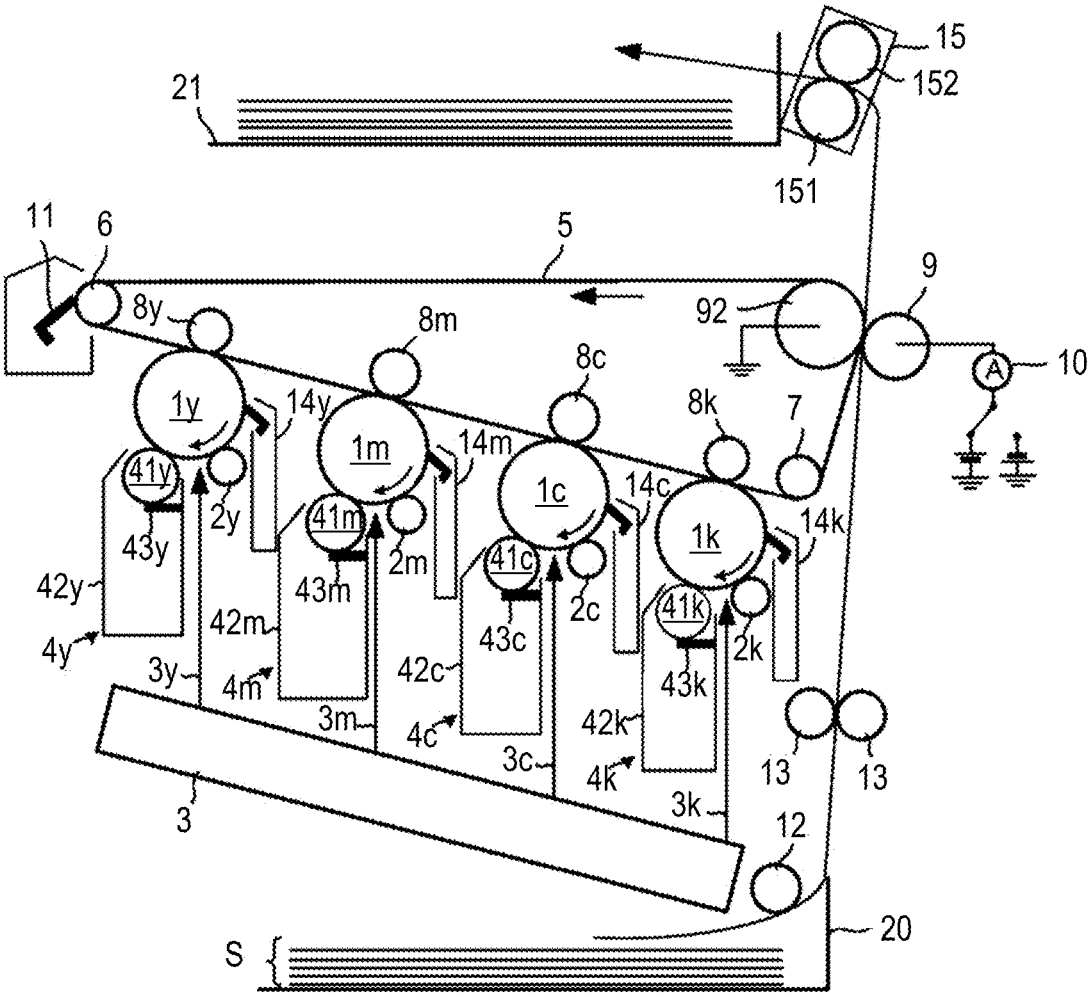
FIG. 2 is a schematic sectional view for illustrating an example of the configuration of an electrophotographic image forming apparatus of an intermediate transfer system.

FIG. 2 is an illustration of an example of an image forming apparatus including the electrophotographic belt according to one aspect of the present disclosure as an intermediate transfer member, the image forming apparatus having a configuration of an electrophotographic image forming apparatus. The image forming apparatus is configured to form a color image through use of toners of four colors on a recording medium S, such as a sheet, fed from a sheet-feeding cassette 20, and image forming stations for respective colors are arrayed in a substantially horizontal direction.

The image forming stations include photosensitive drums (photosensitive members or image bearing members) 1*c*, 1*m*, 1*y*, and 1*k*, respectively. Herein, the suffixes "c", "m", "y", and "k" are added to the reference symbols to indicate that the image forming stations for cyan, magenta, yellow, and black include the members denoted by the reference symbols, respectively. The image forming apparatus includes a laser scanner 3, which is a laser optical unit, and laser beams 3*c*, 3*m*, 3*y*, and 3*k* are emitted from the laser scanner 3 in accordance with image signals for respective colors to irradiate the photosensitive drums 1*c*, 1*m*, 1*y*, and 1*k*, respectively. The image forming station for black is described. A conductive roller 2*k*, which is a contact charging device, a developing device 4*k*, a conductive roller 8*k*, which is a primary transfer roller, and a toner collection blade 14*k*, which is used for cleaning the photosensitive drum 1*k*, are arranged so as to surround the photosensitive drum 1*k*. In the developing device 4*k*, there are arranged a developing roller 41*k*, a developer container 42*k*, and a developing blade 43*k*. The developing roller 41*k* is a developer bearing member configured to develop a latent image formed on the photosensitive drum 1*k*. The developer container 42*k* is configured to hold toner to be supplied to the developing roller 41*k*. The developing blade 43*k* is configured to regulate the amount of toner on the developing roller 41*k*, and to apply an electric charge. The toner in the developer container 42*k* is not shown. The image forming stations for yellow, cyan and magenta have the same structure as that for black as mentioned above. Thus, reference numerals 4*m*, 4*y* and 4*c* are the counterparts of the developing device 4*k*, 41*y*, 41*m* and 41*c* are the counterparts of the developing roller 41*k*, 42*y*, 42*m* and 42*c* are the counterparts of the developer container 42*k*, 43*y*, 43*m* and 43*c* are the counterparts of the developing blade 43*k*, 14*y*, 14*m* and 14*c* are the counterparts of the toner collection blade 14*k*, and 2*m*, 2*y* and 2*c* are the counterparts of the conductive roller 2*k*.

The electrophotographic belt 5 having an endless belt shape is arranged so as to be common to the image forming stations of the respective colors. The electrophotographic belt 5 is stretched around a secondary transfer opposing roller 92, a tension roller 6, and a drive roller 7, and is rotated by the drive roller 7 in the direction indicated by the arrow in FIG. 2. In a section between the tension roller 6 and the drive roller 7, the electrophotographic belt 5 is sequentially brought into abutment against surfaces of the photosensitive drums 1*c*, 1*m*, 1*y*, and 1*k*, and are pressurized by primary transfer rollers 8*c*, 8*m*, 8*y*, and 8*k* toward the photosensitive drums 1*c*, 1*m*, 1*y*, and 1*k*, respectively. With such a configuration, toner images formed on the surfaces of the photosensitive drums 1*c*, 1*m*, 1*y*, and 1*k* are transferred onto an outer peripheral surface of the electrophotographic belt 5 serving as the intermediate transfer member. A secondary transfer roller 9 is arranged so as to be opposed to the opposing roller 92, and the electrophotographic belt 5 is pressurized by the secondary transfer roller 9 toward the opposing roller 92. A secondary transfer voltage is applied to the secondary transfer roller 9 from a power supply through intermediation of a current detection circuit 10. The secondary transfer roller 9 and the opposing roller 92 form a secondary transfer portion. The recording medium S is fed and conveyed by a feed roller 12 and conveyance rollers 13, and passes through a nip portion defined between the electrophotographic belt 5 and the secondary transfer roller 9 at the position of the opposing roller 92. Thus, the toner images borne on the outer peripheral surface of the electrophotographic belt 5 are transferred onto the recording medium S. With those actions, an image is formed on the surface of the recording medium S.

The recording medium S having the toner images transferred thereonto passes through a fixing device 15 including a heating roller 151 and a pressurizing roller 152. Thus, the image is fixed on the recording medium S, and the recording medium S is delivered to a sheet delivery tray 21. At the position of the tension roller 6, there is arranged a cleaning blade 11 brought into abutment against the outer peripheral surface of the electrophotographic belt 5. Toner remaining on the outer peripheral surface of the electrophotographic belt 5 without having been transferred onto the recording medium S is scraped off and removed by the cleaning blade 11. The cleaning blade 11 is a member extending in a direction substantially perpendicular to the moving direction of the electrophotographic belt 5.

A cleaning blade known in the field of an electrophotographic image forming apparatus may be appropriately used as the cleaning blade 11. A material therefor is not particularly limited as long as the material is suitable for toner removal, and may be, for example, a urethane rubber, an acryl rubber, a nitrile rubber, or an ethylene propylene diene rubber (EPDM). From the viewpoint of toner removal performance, the urethane rubber is preferred.

According to one aspect of the present disclosure, the electrophotographic belt that can suppress the occurrence of a cleaning failure even when used for a long time period can be obtained. According to another aspect of the present disclosure, the electrophotographic image forming apparatus that can stably form a high-quality electrophotographic image can be obtained.

EXAMPLES

Now, the electrophotographic belt according to one aspect of the present disclosure is specifically described by way of Examples and Comparative Examples, but the present disclosure is not limited thereto.

[Production of Base Layer]

First, through use of a twin screw extruder (product name: TEX30a, manufactured by The Japan Steel Works, LTD.), the following materials for base layers were thermally melted and kneaded at a ratio of PEN/PEEA/CB=84/15/1 (mass ratio), to thereby prepare a thermoplastic resin composition. The thermal melting and kneading temperature was adjusted so as to fall within the range of from 260° C. or more to 280° C. or less, and the thermal melting and kneading time was set to from about 3 minutes to about 5 minutes.

PEN: Polyethylene naphthalate (product name: TN-8050SC, manufactured by Teijin Chemicals Ltd.)

PEEA: Polyether ester amide (product name: PELESTAT NC6321, manufactured by Sanyo Chemical Industries, Ltd.)

CB: Carbon black (product name: MA-100, manufactured by Mitsubishi Chemical Corporation)

The obtained thermoplastic resin composition was pelletized and dried at a temperature of 140° C. for 6 hours. Then, the dried pellet-shaped thermoplastic resin composition was supplied to an injection molding machine (product name: SE180D, manufactured by Sumitomo Heavy Industries, Ltd.). Then, the thermoplastic resin composition was subjected to injection molding with a mold adjusted to a temperature of 30° C., with a cylinder setting temperature being 295° C., to obtain a preform. The obtained preform had a test tube shape having an outer diameter of 50 mm, an inner diameter of 46 mm, and a length of 100 mm.

Figure 3:
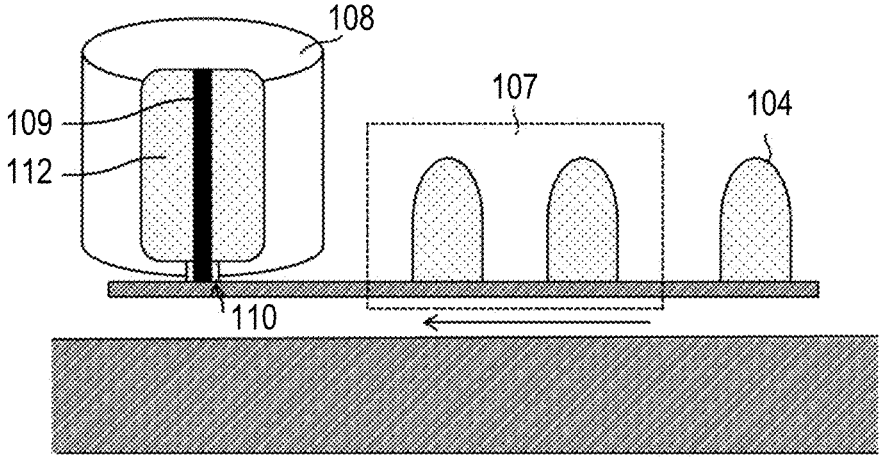
FIG. 3 is a schematic sectional view for illustrating an example of a stretch blow molding machine.

Next, the above-mentioned preform is biaxially stretched through use of a biaxial stretching device (stretch blow molding machine) illustrated in FIG. 3. First, before biaxial stretching, a preform 104 was placed in a heating device 107 including a non-contact type heater (not shown) for heating an outer wall and an inner wall of the preform 104, and was heated with the heater so that the outer surface temperature of the preform reached 150° C.

Then, the heated preform 104 was placed in a blow mold 108 with a mold temperature being kept at 30° C. and stretched in the axial direction of the test tube shape through use of a stretching rod 109. Concurrently, air adjusted to a temperature of 23° C. was introduced into the preform from a blow air injection portion 110 to stretch the preform 104 in a radial direction. Thus, a bottle-shaped molded product 112 was obtained.

Next, a barrel portion of the obtained bottle-shaped molded product 112 was cut, to thereby obtain a base layer having a seamless and endless belt shape. The base layer had a thickness of 70.2 μm, a circumferential length of 712.2 mm, and a width of 244.0 mm.

[Formation of Surface Layer]

The material formulation of a paint for forming a surface layer is shown in Table 1. In Table 1, the number of parts by mass is shown, and the number of parts by mass as a solid content is shown for a component except a solvent.

With regard to each of surface layer formulations No. 1 and No. 3, materials shown in Table 1 were weighed in a vessel, and were stirred with a stirrer for 30 minutes to provide a paint.

In a surface layer formulation No. 2, the following steps were performed for dispersing a polytetrafluoroethylene (PTFE). That is, materials (except a conductive agent) shown in Table 1 were weighed in a vessel, and were subjected to a coarse dispersion treatment. After that, the mixture was subjected to a main dispersion treatment with a high-pressure emulsifying disperser (product name: Nano-Vater, manufactured by Yoshida Kikai Co., Ltd.).

At this time, the main dispersion treatment was performed until the 50% average particle diameter of the PTFE in the mixture became 200 nm. Further, while the conductive agent (slurry) was stirred, the liquid after the completion of the main dispersion treatment was dropped in the conductive agent to provide a paint. The particle diameter of the PTFE in the paint was measured with a concentrated solution-type particle diameter analyzer (product name: FPAR-1000, manufactured by Otsuka Electronics Co., Ltd.) based on a dynamic light scattering (DLS) technique (standard ISO-DIS 22412).

TABLE 1

Surface layer formulation (part(s) by mass)

| Surface layer formulation No. | | 1 | 2 | 3 |
|---|---|---|---|---|
| Acrylic monomer | Polyfunctional acrylate: ARONIX M-305 | 82 | 62 | — |
| | Monofunctional acrylate: ARONIX M-140 | — | — | 82 |
| Fluorine resin | PTFE: LUBRON L-2 | — | 20 | — |
| Dispersant | GF-300 | — | 1 | — |
| Conductive agent | CELNAX CX-Z400K | 14 | 14 | 14 |
| Photoreaction initiator | IRGACURE 907 | 4 | 3 | 4 |
| Solvent | MEK | 200 | 200 | 200 |

Details about materials shown in Table 1 and in Table 2 to be described later are described below. The term "MEK" refers to methyl ethyl ketone.

"ARONIX M-402": product name, manufactured by Toagosei Co., Ltd. polyfunctional acrylate (mixture of dipentaerythritol pentaacrylate and dipentaerythritol hexaacrylate)

"ARONIX M-305": product name, manufactured by Toagosei Co., Ltd.

polyfunctional acrylate, pentaerythritol tri and tetraacrylate

"ARONIX M-140": product name, manufactured by Toagosei Co., Ltd.

monofunctional acrylate, N-acryloyloxyethylhexahydrophthalimide

"LUBRON L-2": product name, manufactured by Daikin Industries, Ltd.

polytetrafluoroethylene (PTFE)

"FLUOROLINK AD1700": product name, manufactured by Solvay Specialty Polymers Japan K.K.

acrylate group-added perfluoropolyether

"GF-300": product name, manufactured by Toagosei Co., Ltd.

dispersant for dispersing PTFE particles

"CELNAX CX-Z410K": product name, manufactured by Nissan Chemical Corporation conductive agent, zinc antimonate particle slurry, 40 mass % in terms of solid content "IRGACURE 907": product name, manufactured by BASF photoreaction initiator "ZINC STEARATE ZP": product name, manufactured by Dainichi Chemical Industry Co., Ltd.

zinc stearate

The base layer produced in the foregoing was fit into the outer periphery of a cylindrical holding mold, and the end portions of the base layer were sealed. After that, the holding mold was immersed in a vessel filled with the paint, and was lifted so that a relative speed between the liquid surface of the paint and the base layer became constant. Thus, a coating film of the paint was formed on the outer peripheral surface of the base layer. The lifting speed (relative speed between the liquid surface of the paint and the base layer) and the solvent ratio of the paint may be adjusted in accordance with a required thickness. Herein, the lifting speed was set to from 10 mm/sec to 50 mm/sec, and the thickness of the coating film was adjusted to 3 μm. The base layer having formed thereon the coating film was left at a temperature of 23° C. under exhaust for 1 minute to dry the coating film. After that, UV light was applied to the coating film by using a UV irradiator (product name: UE06/81-3, manufactured by Eye Graphics Co., Ltd.) until its integrated light quantity became 600 mJ/cm$^2$, thereby curing the coating film. Thus, an electrophotographic belt including a surface layer formed on the outer peripheral surface of the base layer was produced. A section of the surface layer was observed with an electron microscope (product name: XL30-SFEG, manufactured by FEI). As a result, the thickness thereof was found to be 3.0 μm.

[Production and Adhesion of Resin Particles]

The material formulation of a raw material liquid for forming resin particles is shown in Table 2. In Table 2, the number of parts by mass is shown, and the number of parts by mass as a solid content is shown for a component except a solvent.

With regard to each of resin particle formulations No. 5 and No. 10, materials shown in Table 2 were weighed in a vessel, and were stirred with a mix rotor or a stirrer for 30 minutes to provide a raw material liquid.

With regard to each of resin particle formulations Nos. 1 to 4 and 6 to 9, the following steps were performed for dispersing a PTFE. That is, materials (except a conductive agent) shown in Table 2 were weighed in a vessel, and were subjected to a coarse dispersion treatment. After that, the mixture was subjected to a main dispersion treatment with a high-pressure emulsifying disperser (product name: Nano-Vater, manufactured by Yoshida Kikai Co., Ltd.). At this time, the main dispersion treatment was performed until the 50% average particle diameter of the PTFE in the mixture became 200 nm. Thus, a raw material liquid was obtained. In the resin particle formulation No. 3, however, further, while the conductive agent (slurry) was stirred, the liquid after the completion of the main dispersion treatment was dropped in the conductive agent to provide a raw material liquid. The particle diameter of the PTFE in each raw material liquid was measured with a concentrated solution-type particle diameter analyzer (product name: FPAR-1000, manufactured by Otsuka Electronics Co., Ltd.) based on a dynamic light scattering (DLS) technique (standard ISO-DIS 22412). With regard to each of resin particle formulations No. 11 and 12, the above-mentioned steps, such as stirring, were not performed because a material available from its manufacturer was used as it was as resin particles.

TABLE 2

| Resin particle formulation (part(s) by mass) | | | | | | | | | | | | | |
|---|---|---|---|---|---|---|---|---|---|---|---|---|---|
| Resin particle formulation No. | | 1 | 2 | 3 | 4 | 5 | 6 | 7 | 8 | 9 | 10 | 11 | 12 |
| Acrylate | Polyfunctional acrylate: ARONIX M-305 | — | 75 | 62 | — | 75 | 45 | 85 | 24 | 90 | 95 | — | — |
| | Polyfunctional acrylate: ARONIX M-402 | 75 | — | — | — | — | — | — | — | — | — | — | — |
| | Monofunctional acrylate: ARONIX M-140 | — | — | — | 75 | — | — | — | — | — | — | — | — |
| Fluorine resin | PTFE: LUBRON L-2 | 20 | 20 | 20 | 20 | — | 50 | 10 | 70 | 5 | — | 100 | — |
| | FLUOROLINK AD1700 | — | — | — | — | 20 | — | — | — | — | — | — | — |
| Dispersant | GF-300 | 1 | 1 | 1 | 1 | — | 2 | 1 | 3 | 1 | — | — | — |
| Conductive agent | CELNAX CX-Z400K | — | — | 14 | — | — | — | — | — | — | — | — | — |
| Photoreaction initiator | IRGACURE 907 | 4 | 4 | 3 | 4 | 5 | 3 | 4 | 3 | 5 | 5 | — | — |
| Solvent | MEK | 200 | 200 | 200 | 200 | 200 | 200 | 200 | 200 | 200 | 200 | — | — |
| Metal soap | ZINC STEARATE ZP | — | — | — | — | — | — | — | — | — | — | — | 100 |

Each of the raw material liquids obtained in the foregoing was applied to a PTFE sheet (product name: NAFLON, manufactured by NICHIAS Corporation) with a wire bar so as to have a thickness of from 2 μm to 4 μm. The thickness was measured with a white interferometer (product name: VertScan R3300HL, manufactured by Ryoka Systems Inc.).

After that, the coating film was dried at a temperature of 23° C. under exhaust for 5 minutes. After that, UV light was applied to the coating film by using a UV irradiator (product name: UE06/81-3, manufactured by Eye Graphics Co., Ltd.) until its integrated light quantity became 600 mJ/cm$^2$, thereby curing the coating film. The resultant coating film was peeled from the PTFE sheet, and the peeled coating film was pulverized with a ball mill (product name: AV-1, manufactured by Asahi Rika Seisakusho, K.K.) at 100 rpm over 5 hours. The resultant pulverized product was sieved with a 100-mesh sieve so that coarse powder was removed. Thus, resin particles were obtained.

The short diameter of the resin particles was 3.8 μm. The short diameter of the resin particles was measured from an image obtained with a scanning electron microscope (product name: Sigma 500VP; manufactured by Carl Zeiss). The resin particles were observed with the scanning electron microscope at a magnification of 7,000, and their shortest diameters were determined from their image. The average of the shortest diameters of 50 resin particles was adopted as the short diameter of the resin particles.

The resultant resin particles were spread on the surface layer of the endless belt with a sieve, and were caused to adhere to the surface layer by being rubbed against the layer with waste. While the surface layer was observed with a digital microscope (product name: VHX-500, manufactured by Keyence Corporation), the addition and wiping of the resin particles were performed to adjust their adhesion amount. Thus, an electrophotographic belt was produced. However, a surface layer production method, a resin particle production method, and a resin particle adhesion method in Examples 4 are described later.

<Evaluation Method>

Methods of evaluating the characteristic values and performance of an electrophotographic belt produced in each of Examples and Comparative Examples are described below.

Ratio at which Resin Particles Cover Outer Surface of Surface Layer (Particle-Covering Area Ratio)

The outer surface of the surface layer of the electrophotographic belt was observed with a digital microscope (product name: VHX-500, manufactured by Keyence Corporation), and a still image of a rectangular observing area having a size of 715 μm×535 μm was obtained. In the still image, the area of a portion where the resin particles were observed (resin particle portion area) was determined, and the ratio (resin particle portion area/total area) of the area to the total area of the still image was determined. The ratio was measured at 20 points on the outer surface of the surface layer, and the average of the measured values was adopted as a particle-covering area ratio. With regard to such a sample that the particle-covering area ratio in the central portion of the belt and those in both end portions thereof were different from each other, a region distant from an end portion in the width direction of the belt toward the center in the direction by up to 20 mm was adopted as an end portion, and a region ranging from a portion distant from the end portion in the width direction of the belt toward the center by 20 mm to the center was adopted as the central portion, followed by the measurement of the ratio at 20 points in each of the regions to determine the particle-covering area ratio.

Exposure of Second Acrylic Resin and Fluorine Resin to Outer Surface of Each of Resin Particles The exposure of an acrylic resin and a fluorine resin to the outer surface of each of resin particles was confirmed by measuring information about an element on the surface of a material and information about chemical bonding on the surface of the material through analysis with a scanning electron microscope (SEM) and an energy dispersive X-ray spectrometer (EDS), and the microscopic attenuated total reflection measurement method (ATR) of Fourier transform infrared spectroscopy (FT-IR analysis).

"X-MAXN80" (product name, manufactured by Oxford Instruments) was used in energy dispersive X-ray spectrometry, and "Frontier Spotlight 400" (product name, manufactured by PerkinElmer, Inc.) capable of performing microscopic ATR analysis was used in FT-IR.

Specifically, first, the surfaces of the resin particles were observed with the SEM at a magnification of 7,000, and EDS analysis was performed to confirm that a carbon atom and a fluorine atom were detected. Further, about one to two spatulas of the resin particles were prepared, and the IR spectrum of the surfaces of the resin particles was measured with the microscopic ATR unit of the FT-IR analyzer. As a result, peaks at around 1,213 cm$^{-1}$ and around 1,155 cm$^{-1}$, which were each derived from a C—F bond (fluorine resin), were observed. In addition, peaks at around 2,925 cm$^{-1}$, around 2,850 cm$^{-1}$, and around 1,470 cm$^{-1}$, which were each derived from a methylene group (acrylic resin), and a peak at around 1,735 cm$^{-1}$, which was derived from the C═O of an R—COO—R group (acrylic resin), were observed.

Evaluation of Toner Removal Performance (Number of Toner Slippings after 100,000-Sheet Endurance)

A laser beam printer (product name: LBP712Ci, manufactured by Canon Inc.) that had been reconstructed (its charging brush for toner recovery had been removed) was used as an electrophotographic image forming apparatus having a configuration illustrated in FIG. 2. Toner removal performance was evaluated by: mounting the electrophotographic belt as an intermediate transfer belt on the electrophotographic image forming apparatus; and performing blade cleaning while printing an image. The procedure of the evaluation is described below.

Under an environment having a temperature of 15° C. and a relative humidity of 10%, Japanese Industrial Standards (JIS) A4 size paper (product name: Extra; manufactured by OCE, basis weight: 80 g/m$^2$) was used as the recording medium S, and images were output on 100,000 sheets by 2-sheet intermittent printing. At this time, an E-letter image (image of the letter "E") was output at a print percentage of 1%.

After that, the number of toner slippings from the cleaning blade was counted. Specifically, under a state in which the secondary transfer voltage of the apparatus was turned off (0 V), the photosensitive drum 1*y* was irradiated with the laser light 3*y*, and the photosensitive drum 1*m* was irradiated with the laser light 3*m* so that a red image (yellow and magenta toners) was recorded on the entire surface of the A4 size paper. After that, the cleaning blade 11 was caused to clean the entire surface of the A4 size paper once, followed by the stopping of the rotation of the belt. The electrophotographic belt was removed from the electrophotographic image forming apparatus, and its outer peripheral surface was observed, followed by the counting of sites where the toners remained. At this time, even such a slight residual toner as not to be found when transferred onto the recording medium (paper) was counted as a toner slipping. The number of toner slippings was separately counted for each of the central portion and both end portions of the belt.

Evaluation of Degree of Adhesion of Resin Particles (Particle-Remaining Ratio after Tape-Peeling Operations)

The outer surface of the surface layer of the electrophotographic belt was observed with a digital microscope (product name: VHX-500, manufactured by Keyence Corporation). Thus, its still image was obtained.

In the still image, the area of a portion to which the resin particles adhered (resin particle portion area) was determined. After that, the following adhesive tape-peeling operation was repeated five times: an adhesive tape (product name: 3M HEAT-RESISTANT POLYIMIDE TAPE, manufactured by 3M Japan Limited) was bonded to the outer surface, and was then peeled; provided that a new adhesive surface was used every time the adhesive tape was bonded. After that, the same site as the site whose still image had been acquired in advance was observed with the digital microscope again, and the area of a portion to which the resin particles adhered was determined. The remaining ratio at which the resin particles before the adhesive tape-peeling operations remained after the adhesive tape-peeling operations, that is, the ratio of the resin particle portion area after the adhesive tape-peeling operations to the resin particle portion area before the adhesive tape-peeling operations was calculated.

Example 1

As shown in Table 3, a surface layer was formed on the outer peripheral surface of the base layer described in the foregoing through the use of a paint, which had been produced in accordance with the surface layer formulation No. 1, as described in the foregoing. In addition, resin particles were produced in accordance with the resin particle formulation No. 1 as described in the foregoing. An electrophotographic belt was produced by causing the resin particles to adhere to the outer surface of the surface layer as described in the foregoing, and was evaluated. The image after the endurance was extremely satisfactory. Production conditions (e.g., the combination of a surface layer formulation and a resin particle formulation) for the electrophotographic belts of the respective examples and comparative examples, and the evaluation results of the belts are shown in Table 3.

Examples 2, 3, 5-1 to 5-4, 6, 7, and 8-1 to 8-4, and Comparative Examples 1 to 3

Electrophotographic belts were each produced and evaluated in the same manner as in Example 1 except that the surface layer formulation, the resin particle formulation, and the particle-covering area ratio were changed as shown in Table 3.

In each of Examples 5-3, 6, and 8-3 and 8-4 out of those examples, the image after the endurance was satisfactory, and in each of the other examples, the image after the endurance was extremely satisfactory. In Example 5-4, however, in an initial image before the sheet-passing endurance, a solid image had a slightly dry and crumbly feeling. The foregoing may result from the fact that the adhesion amount of the resin particles was large, and hence the transferability of the toner was slightly reduced by an adhesion force between the toner and the resin particles.

In Comparative Example 1, resin particles each of which was free of any fluorine resin were used. In Comparative Example 2, resin particles each of which was free of any acrylic resin were used. In Comparative Example 3, metal soap was used instead of resin particles. In each comparative example, many toner slipping traces were observed in the image after the endurance.

Example 4-1

A coating film of a paint produced in accordance with the surface layer formulation No. 2 was formed on the outer peripheral surface of the base layer described in the foregoing through the use of the paint by the method described in the foregoing. Next, UV light was applied to the coating film until its integrated light quantity became 60 mJ/cm. At this time, the coating film was in such a "semi-cured state" that the coating film did not completely cure, and hence the coating film was in such a state as to easily deform.

Figure 4:
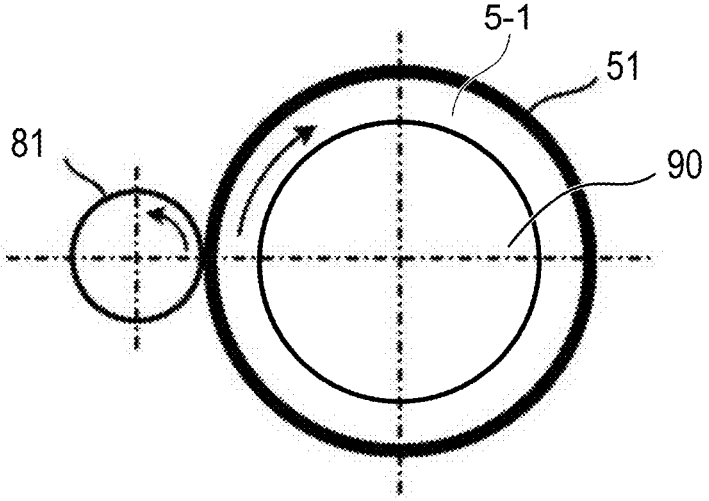
FIG. 4 is a schematic view for illustrating an example of the configuration of an imprint processing apparatus configured to form a groove in the surface of an electrophotographic belt.

After that, grooves extending in the peripheral direction of the base layer 5-1 were formed in the outer surface of a coating film 51 in a semi-cured state, which had been formed on the outer peripheral surface of the base layer 5-1, with an imprint processing apparatus illustrated in FIG. 4 by the following method. First, a mold obtained by forming a plurality of convex patterns extending in the peripheral direction on the outer peripheral surface of a column having a diameter of 50 mm and a length of 250 mm through cutting was prepared as a cylindrical mold 81 for forming a groove. Details about the convex patterns were as follows: the height of each convex was 3.5 μm; the length of the bottom of the convex was 2.0 μm; the length of the apex of the convex was 0.2 μm; an interval between the convex patterns was 20 μm; and each convex pattern was continuously formed in the peripheral direction so as to make one round of the mold. The mold was produced from carbon steel (S45C) subjected to electroless nickel plating.

Next, the base layer 5-1 having the coating film 51 formed on its outer surface was fit into the outer periphery of a cylindrical holding mold 90 (peripheral length: 712 mm). The imprint processing apparatus was able to cause both of the cylindrical mold 81 and the holding mold 90 to rotate. While the respective axial center lines of the mold 81 and the holding mold 90 were maintained parallel to each other, the cylindrical mold 81 was pressed against the holding mold 90 at a pressing force of 60 MPa, and the molds were caused to rotate at a number of revolutions of 30 mm/sec in directions opposite to each other. Thus, the convex patterns of the cylindrical mold 81 were transferred onto the outer surface of the coating film in a semi-cured state. When the rotation of the holding mold 90 exceeded one round by 1 mm, the cylindrical mold 81 was separated from the holding mold 90.

As a result of the processing, the grooves extending in the peripheral direction were formed in the outer surface of the coating film 51. In addition, resin particles each having the same composition as that of the surface layer formulation No. 2 (identical in composition to the resin particle formulation No. 3, acrylic resin ratio: 62 mass %, fluorine resin ratio: 20 mass %) adhered to the outer surface of the coating film 51.

A possible reason for the adhesion of the resin particles to the outer surface of the coating film 51 as a result of the processing is as described below.

That is, when the cylindrical mold 81 is pressed against the coating film 51 at a high pressure, the cylindrical mold 81 slightly undergoes an elastic deformation in its axial direction. The elastic deformation causes a relative shift between the coating film 51 and the cylindrical mold 81 in the axial direction. In the convex pattern portion of the cylindrical mold 81, as a result of the shift, part of the surface layer of the coating film 51 is shaved by the cylindrical mold 81, and hence resin particles having a short diameter of about 1 μm, the resin particles each having the same composition as that of the coating film 51, are produced. The resin particles are pressed against the outer surface of the coating film 51 by the cylindrical mold 81 to adhere to the outer surface of the coating film 51.

Next, UV light was applied to the coating film 51 by using a UV irradiator (product name: UE06/81-3, manufactured by Eye Graphics Co., Ltd.) until its integrated light quantity became 600 mJ/cm$^2$ in total including 60 mJ/cm$^2$ described in the foregoing, thereby sufficiently curing the coating film 51 and the resin particles adhering onto the outer surface of the coating film 51. Thus, an electrophotographic belt was produced. The resultant electrophotographic belt was evaluated in the same manner as in Example 1.

Example 4-2

A belt was produced in the same manner as in Example 4-1 except that the cylindrical shape of the cylindrical mold 81 for forming a groove was changed to a reverse crown shape. While the cylindrical shape of the mold 81 was straight in Example 4-1, in this example, the reverse crown shape was adopted so that a pressure concentrated on the end portions of the endless belt. As a result, the amount of the shift was larger in both end portions of the belt than in the central portion thereof. As a result, the resin particles were produced in a larger amount in both the end portions than in the central portion. The convex patterns of the cylindrical mold 81 for forming a groove were the same as those of Example 4-1. A reverse crown amount was as follows: a radius at a center in the axial direction of the cylindrical mold 81 for forming a groove and that at an end therein differed from each other by 5 μm.

In each of the electrophotographic belts according to Examples 4-1 and 4-2 described above, in the surface layer production process, UV light was further applied to the coating film 51 in a semi-cured state, the coating film having the resin particles adhering to its outer surface, to cure the coating film. Probably as a result of the foregoing, the resin particles more strongly stuck to the outer surface of the electrophotographic belt, and were hence in such a state as to hardly move to any other member. Probably as a result of the foregoing, in each of the electrophotographic belts according to Examples 4-1 and 4-2, the resin particle-remaining ratio after the tape-peeling operations became extremely high.

TABLE 3

Production conditions for electrophotographic belts and evaluation results of the belts

| | Surface layer formulation No. | Resin particle formulation No. | Presence or absence of grooves in surface layer | Material ratio of resin particles mass % | | Particle-covering area ratio % | |
|---|---|---|---|---|---|---|---|
| | | | | Acrylic resin | Fluorine resin | Central portion | Both end portions |
| Example 1 | 1 | 1 | Absent | 75 | 20 | 3 | 3 |
| Example 2 | 1 | 2 | Absent | 75 | 20 | 3 | 3 |
| Example 3 | 1 | 2 | Absent | 75 | 20 | 3 | 12 |
| Example 4-1 | 2 | 3 | Present | 62 | 20 | 3 | 3 |
| Example 4-2 | 2 | 3 | Present | 62 | 20 | 3 | 15 |
| Example 5-1 | 1 | 2 | Absent | 75 | 20 | 0.5 | 0.5 |
| Example 5-2 | 1 | 2 | Absent | 75 | 20 | 30 | 30 |
| Example 5-3 | 1 | 2 | Absent | 75 | 20 | 0.1 | 0.1 |
| Example 5-4 | 1 | 2 | Absent | 75 | 20 | 35 | 35 |
| Example 6 | 3 | 4 | Absent | 75 | 20 | 3 | 3 |
| Example 7 | 1 | 5 | Absent | 75 | 20 | 3 | 3 |
| Example 8-1 | 1 | 6 | Absent | 45 | 50 | 3 | 3 |
| Example 8-2 | 1 | 7 | Absent | 85 | 10 | 3 | 3 |
| Example 8-3 | 1 | 8 | Absent | 24 | 70 | 3 | 3 |
| Example 8-4 | 1 | 9 | Absent | 90 | 5 | 3 | 3 |
| Comparative Example 1 | 1 | 10 | Absent | 95 | 0 | 3 | 3 |
| Comparative Example 2 | 1 | 11 | Absent | 0 | 100 | 3 | 3 |
| Comparative Example 3 | 1 | 12 | Absent | — | — | 3 | 3 |

| | Number of toner slippings after endurance | | Particle-remaining ratio after tape-peeling operations % | Outline |
|---|---|---|---|---|
| | Central portion | Both end portions | | |
| Example 1 | 0 | 5 | 73 | The first and second acrylic resins have different structures. |
| Example 2 | 0 | 3 | 85 | The first and second acrylic resins have the same structure. |
| Example 3 | 0 | 2 | 84 | Particles are present in a larger amount in both end portions than in the central portion. |
| Example 4-1 | 0 | 1 | 98 | Grooves are present. |
| Example 4-2 | 0 | 0 | 98 | Grooves are present, and particles are present in a larger amount in both end portions than in the central portion. |

TABLE 3-continued

| Production conditions for electrophotographic belts and evaluation results of the belts | | | | |
|---|---|---|---|---|
| Example 5-1 | 0 | 5 | 84 | The particle adhesion amount is changed. |
| Example 5-2 | 0 | 2 | 86 | The particle adhesion amount is changed. |
| Example 5-3 | 2 | 10 | 85 | The particle adhesion amount is changed. |
| Example 5-4 | 0 | 2 | 85 | The particle adhesion amount is changed. |
| Example 6 | 1 | 8 | 87 | Monofunctional acrylic monomer |
| Example 7 | 0 | 8 | 80 | Fluorine resin that is not a PTFE |
| Example 8-1 | 0 | 5 | 70 | The ratio between the acrylic and fluorine resins is changed. |
| Example 8-2 | 0 | 6 | 84 | The ratio between the acrylic and fluorine resins is changed. |
| Example 8-3 | 2 | 8 | 68 | The ratio between the acrylic and fluorine resins is changed. |
| Example 8-4 | 1 | 7 | 88 | The ratio between the acrylic and fluorine resins is changed. |
| Comparative Example 1 | 30 | 15 | 70 | Acrylic resin alone |
| Comparative Example 2 | 35 | 12 | 35 | Fluorine resin alone |
| Comparative Example 3 | 33 | 13 | 38 | Metal soap |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-123617, filed Jul. 2, 2019, which is hereby incorporated by reference herein in its entirety.

What is claimed is:

1. An electrophotographic belt comprising a surface layer containing a first acrylic resin, wherein resin particles are present on an outer surface of the surface layer, the resin particles each contain a second acrylic resin and a fluorine resin, the second acrylic resin and the fluorine resin are exposed to an outer surface of each of the resin particles, and a ratio at which the resin particles cover the outer surface of the surface layer is 0.1 to 35%.

2. The electrophotographic belt according to claim 1, wherein the first acrylic resin and the second acrylic resin each have repeating units of the same structure.

3. The electrophotographic belt according to claim 1, wherein in the outer surface of the surface layer, the resin particles are present in a larger amount in both end portions in a width direction of the electrophotographic belt than in a central portion therein.

4. The electrophotographic belt according to claim 1, wherein the outer surface of the surface layer has arranged therein a plurality of grooves extending in a peripheral direction of the electrophotographic belt.

5. The electrophotographic belt according to claim 1, wherein the first acrylic resin and the second acrylic resin are each a polymerized product of a polyfunctional acrylate monomer.

6. The electrophotographic belt according to claim 1, wherein the fluorine resin is a polytetrafluoroethylene.

7. The electrophotographic belt according to claim 1, wherein a content of the second acrylic resin in the resin particles is 24 to 90 mass %, and a content of the fluorine resin therein is 5 to 70 mass %.

8. The electrophotographic belt according to claim 1, wherein the electrophotographic belt has a thickness of 10 to 500 μm.

9. The electrophotographic belt according to claim 1, wherein the electrophotographic belt has an endless belt shape.

10. The electrophotographic belt according to claim 9, wherein the electrophotographic belt comprises a base layer having an endless belt shape, and the surface layer on an outer peripheral surface of the base layer.

11. The electrophotographic belt according to claim 10, further comprising an elastic layer between the base layer and the surface layer.

12. The electrophotographic belt according to claim 10, wherein the surface layer has a thickness of 0.1 to 50 μm.

13. An electrophotographic image forming apparatus comprising:

an electrophotographic belt comprising a surface layer containing a first acrylic resin; and a cleaning blade brought into abutment against an outer surface of the electrophotographic belt, wherein resin particles are present on said outer surface, the resin particles each contain a second acrylic resin and a fluorine resin, the second acrylic resin and the fluorine resin are exposed to an outer surface of each of the resin particles, and a ratio at which the resin particles cover the outer surface of the surface layer is 0.1 to 35%.

* * * * *